US010461456B2

(12) United States Patent
Mochizuki et al.

(10) Patent No.: US 10,461,456 B2
(45) Date of Patent: Oct. 29, 2019

(54) CONNECTOR

(71) Applicant: Yazaki Corporation, Tokyo (JP)

(72) Inventors: Nobuyoshi Mochizuki, Makinohara (JP); Kouichirou Matsushita, Makinohara (JP); Naoki Takamura, Makinohara (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/959,798

(22) Filed: Apr. 23, 2018

(65) Prior Publication Data

US 2018/0316116 A1 Nov. 1, 2018

(30) Foreign Application Priority Data

Apr. 27, 2017 (JP) ..... 2017-087928

(51) Int. Cl.
*H01R 13/40* (2006.01)
*H01R 13/422* (2006.01)
*H01R 13/436* (2006.01)

(52) U.S. Cl.
CPC ..... *H01R 13/4223* (2013.01); *H01R 13/4362* (2013.01)

(58) Field of Classification Search
CPC ..... H01R 13/4223; H01R 23/725; H01R 13/432; H01R 13/113
USPC ..... 439/595, 682, 748, 752.5
See application file for complete search history.

(56) References Cited

U.S. PATENT DOCUMENTS 6,729,904 B2 * 5/2004 Nankou ..... H01R 13/113 439/595
2004/0038595 A1 * 2/2004 Ishikawa ..... H01R 13/4223 439/748

FOREIGN PATENT DOCUMENTS

JP 2001-326011 A 11/2001
JP 2005158418 A 6/2005

* cited by examiner

*Primary Examiner* — Phuong Chi Thi Nguyen
(74) *Attorney, Agent, or Firm* — Sughrue Mion, PLLC

(57) ABSTRACT

The connector includes: a housing provided with a terminal accommodating chamber; a terminal to be accommodated in the terminal accommodating chamber; a locking lance flexibly provided in the terminal accommodating chamber, a free end side of the locking lance configured to abut on the terminal when the terminal is inserted into the terminal accommodating chamber, thereby the locking lance being restored after being bent, thereby the free end side being capable of locking the terminal in the terminal accommodating chamber; and a thin-walled portion flexibly provided on the free end side of the locking lance, a thickness in a bending direction of the locking lance being set to be smaller than a thickness on a base end side of the locking lance in the thin-walled portion.

1 Claim, 10 Drawing Sheets

CONNECTOR

CROSS REFERENCE TO RELATED APPLICATION

The present application is based on, and claims priority from Japanese Patent Application No. 2017-087928, filed Apr. 27, 2017, the disclosure of which is hereby incorporated by reference herein in its entirety.

TECHNICAL FIELD

The present application relates to a connector, and more particularly, to a connector having a locking lance for locking a terminal accommodated in a terminal accommodating chamber.

BACKGROUND ART

As a connector of a conventional example, a connector including a housing provided with a terminal accommodating chamber, a terminal accommodated in the terminal accommodating chamber, and a locking lance flexibly provided in the terminal accommodating chamber and capable of locking the terminal to the terminal accommodating chamber is known (see JP 2001-326011 A).

In the connector of the conventional example, a free end side of the locking lance is engageably arranged in the terminal, and when the terminal is inserted into the terminal accommodating chamber, the free end side of the locking lance abuts on the terminal, thereby the locking lance being restored after being bent, so that the terminal is locked in the terminal accommodating chamber.

SUMMARY

In the connector of the conventional example, a thinned portion is provided on the surface in the bending direction of the locking lance. The thinned portion is provided to reduce the amount of entry in the bending direction of the locking lance into the terminal accommodating chamber when the locking lance is bent.

In the connector of the conventional example, when the terminal is inserted into the terminal accommodating chamber, the free end side of the locking lance abuts on the terminal, whereby the locking lance is bent from the base end side. For this reason, the stress generated due to the bending of the locking lance concentrates on the base end side of the locking lance.

Due to the stress concentrating on the base end side of the locking lance, there is a risk that deformation and damage occurs on the base end side of the locking lance and holding of the terminal with the locking lance is unstable.

Therefore, the present application has an object to provide a connector that can stabilize a terminal holding with a locking lance.

A connector according to an aspect of the present application includes: a housing provided with a terminal accommodating chamber; a terminal to be accommodated in the terminal accommodating chamber; a locking lance flexibly provided in the terminal accommodating chamber, a free end side of the locking lance configured to abut on the terminal when the terminal is inserted into the terminal accommodating chamber, thereby the locking lance being restored after being bent, thereby the free end side being capable of locking the terminal in the terminal accommodating chamber; and a thin-walled portion flexibly provided on the free end side of the locking lance, a thickness in a bending direction of the locking lance being set to be smaller than a thickness on a base end side of the locking lance in the thin-walled portion.

Since the thin-walled portion in which the thickness in the bending direction of the locking lance is set smaller than the thickness on the base end side of the locking lance is flexibly provided on the free end side of the locking lance, when the terminal is inserted into the terminal accommodating chamber, the free end side of the locking lance abuts on the terminal, whereby the thin-walled portion is also bent in addition to the base end side of the locking lance being bent.

For this reason, the stress generated by the locking lance being bent can be dispersed to the base end side of the locking lance and the thin-walled portion, the base end side of the locking lance can be prevented from being deformed or damaged, and the strength on the base end side of the locking lance can be maintained.

Therefore, the concentration of the stress only on the base end side of the locking lance due to the bending of the thin-walled portion can be prevented, and the holding of the terminal with the locking lance can be stabilized.

Preferably, the thickness of the locking lance in the bending direction is continuously set smaller from the base end side to the free end side.

With this configuration, since the locking lance is bent in a plurality of places between the base end and the free end of the locking lance, the stress can be dispersed, and furthermore, the strength on the base end side of the locking lance can be maintained.

Preferably, the locking lance is formed in an arc shape from the base end side to the free end side with respect to the bending direction of the locking lance.

With this configuration, as compared with the case where the locking lance is formed in a straight line, the length of the locking lance can be reduced, and the connector can be reduced in size.

Preferably, the free end side of the locking lance is arranged on the terminal side from the base end side of the locking lance by the amount of the deflection margin of the locking lance with respect to the bending direction of the locking lance.

With this configuration, providing the locking lance itself with a deflection margin of the locking lance makes it unnecessary to provide a space for allowing bending of the locking lance in the terminal accommodating chamber, and the connector can be reduced in size.

According to the connector of the aspect in the present application, the holding of the terminal with the locking lance can be stabilized.

DESCRIPTION OF EMBODIMENTS

Figure 1:
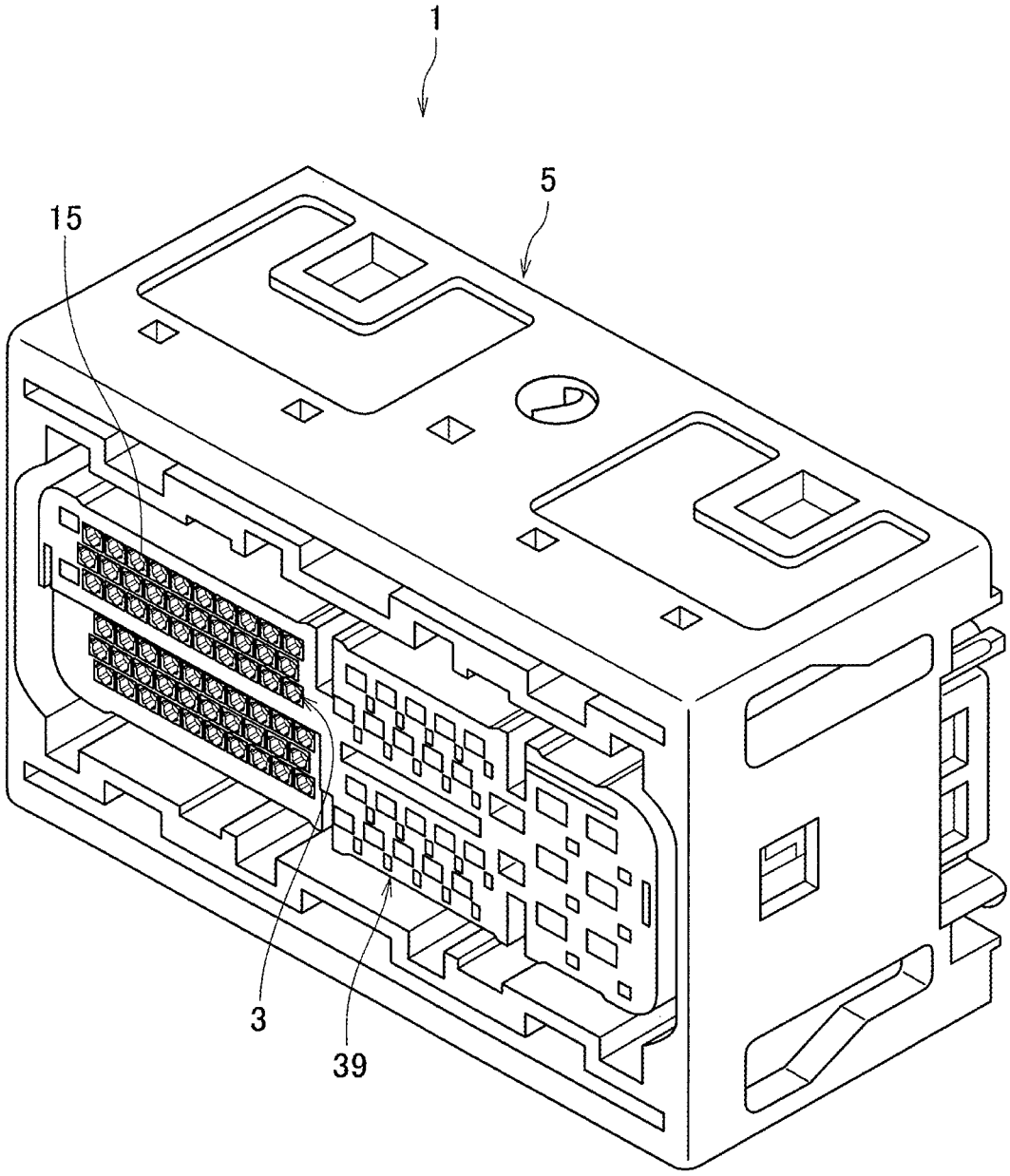
FIG. 1 is a perspective view of a connector according to an embodiment.
Figure 2:
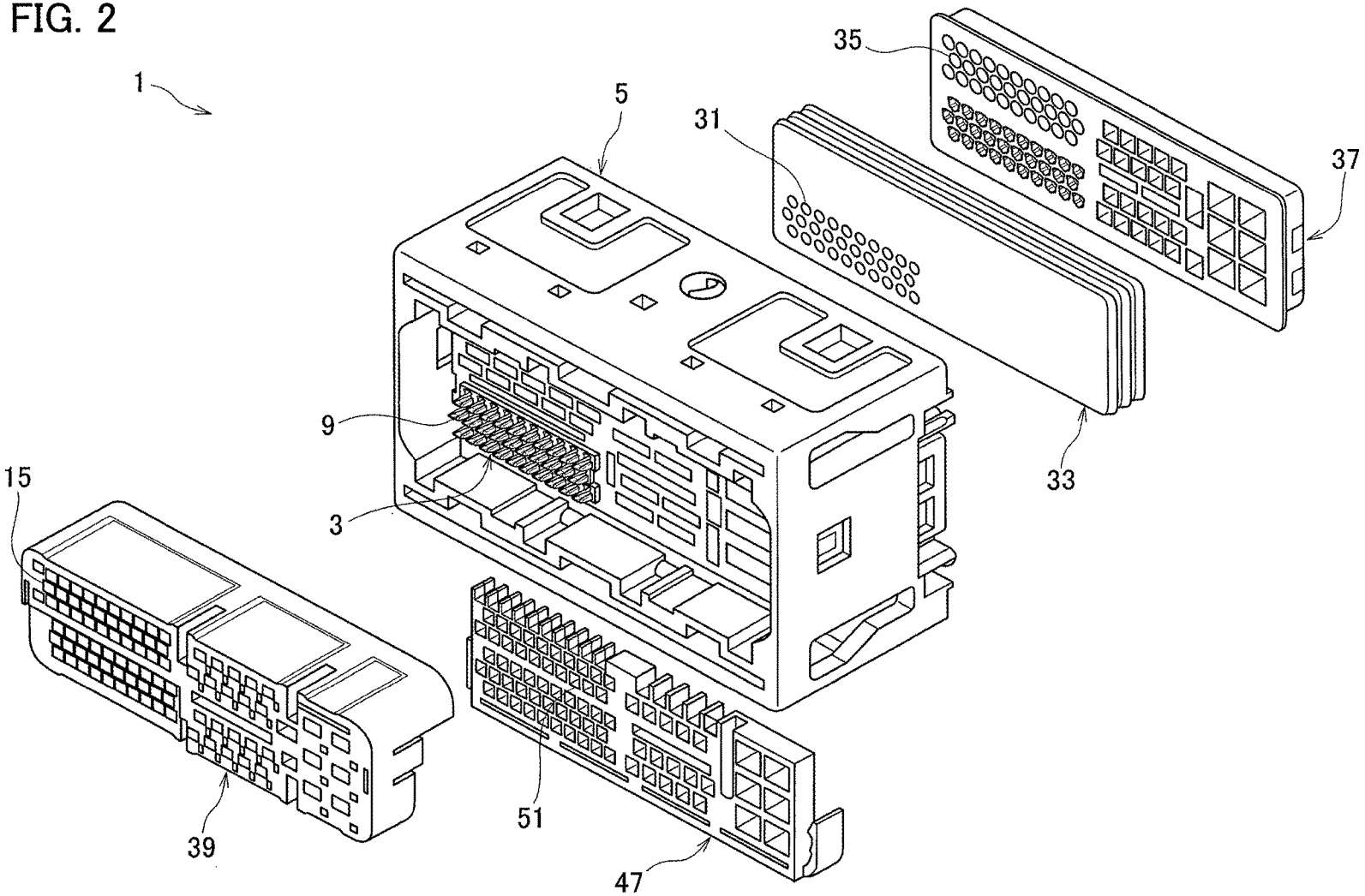
FIG. 2 is an exploded perspective view of the connector according to the embodiment.

A connector according to an embodiment will be described with reference to FIGS. 1 to 10.

The connector 1 according to the embodiment includes: a housing 5 provided with terminal accommodating chambers 3, terminals 7 to be accommodated in the terminal accommodating chambers 3, and locking lances 9 flexibly provided in the terminal accommodating chambers 3, when the terminals 7 are inserted into the terminal accommodating chambers 3, a free end side of each of the locking lances 9 abutting on corresponding terminal 7, thereby the locking lances 9 being restored after being bent, thereby each free end side capable of locking the corresponding terminal 7 in each of the terminal accommodating chambers 3.

Figure 3:
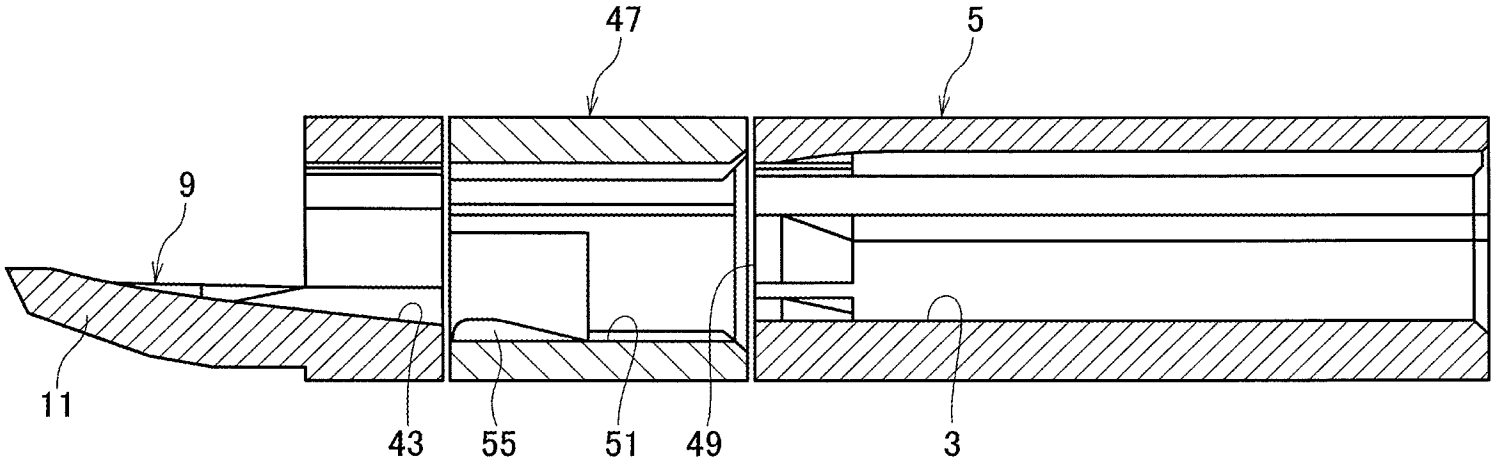
FIG. 3 is a cross-sectional view of a main part of a housing of the connector according to the embodiment.
Figure 4:
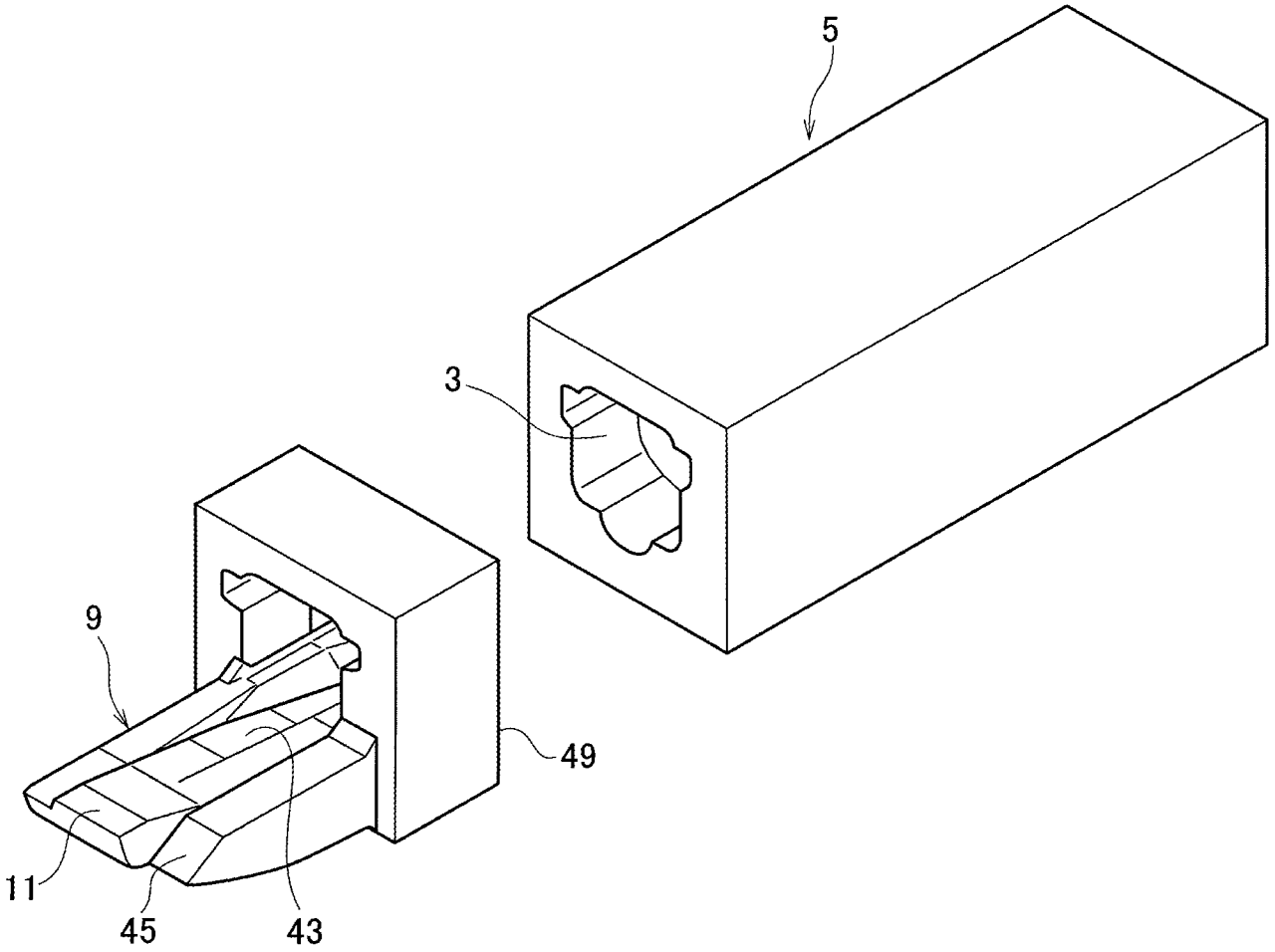
FIG. 4 is a perspective view of a main part in which a part of the housing of the connector according to the embodiment is taken as a cross section.

On the free end side of each locking lance 9 is provided a flexible thin-walled portion 11 in which the thickness of the locking lance 9 in the bending direction is set smaller than that of the locking lance 9 on the base end side (see FIGS. 3, 4, and the like).

The thickness of the locking lance 9 in the bending direction is continuously set smaller from the base end side to the free end side.

The locking lance 9 is formed in an arc shape from the base end side to the free end side.

The free end side of the locking lance 9 is arranged on the terminal 7 side from the base end side of the locking lance 9 by the amount of the deflection margin of the locking lance 9.

The housing 5 is made of an insulating material such as a synthetic resin. In the housing 5, a lever (not illustrated) is rotatably assembled across both side walls. The housing 5 can be fitted to a mating housing (not illustrated) by rotation of a lever (not illustrated).

In the housing 5, the plurality of terminal accommodating chambers 3 is provided. A plurality of mating terminals (not illustrated) accommodated in the mating housing (not illustrated) are electrically connected to the plurality of terminals 7 accommodated in the plurality of terminal accommodating chambers 3 by the housing 5 being fitted to the mating housing (not illustrated).

One end side in the longitudinal direction of each of the terminal accommodating chambers 3 is an insertion opening 13 for inserting corresponding terminal 7 into each of the terminal accommodating chambers 3. The other end side in the longitudinal direction of each of the terminal accommodating chambers 3 serves as the connection opening 15 into which a male tab-shaped connection portion (not illustrated) of the mating terminal to be connected to the corresponding terminal 7 accommodated inside each of the terminal accommodating chambers 3 is inserted.

The plurality of terminals 7 is accommodated in the respective terminal accommodating chambers 3 from the insertion openings 13 on one end side in the longitudinal direction.

Each of the terminals 7 is formed of a single continuous member of the electric wire connecting portion 17 and the connection portion 19 by a punching process, a bending process, and the like being performed on one plate material made of a conductive material.

The electric wire connecting portion 17 includes a cover crimping portion 21 and a core wire crimping portion 23.

The cover crimping portion 21 includes a pair of crimping pieces. The pair of crimping pieces of the cover crimping portion 21 is crimped onto a covering portion of the electric wire 25 at an end portion of the electric wire 25 connected to a power supply, equipment, or the like.

Crimping the cover crimping portion 21 onto the covering portion of the electric wire 25 causes the terminal 7 to be fixed to the electric wire 25.

The core wire crimping portion 23 includes the pair of crimping pieces provided between the connection portion 19 and the cover crimping portion 21. The pair of crimping pieces of the core wire crimping portion 23 is crimped to the core wire portion exposed from the covering portion of the electric wire 25 at the end portion of the electric wire 25.

Crimping the core wire crimping portion 23 onto the core wire portion of the electric wire 25 causes the terminal 7 to be electrically connected to the electric wire 25.

The connection portion 19 includes a female connection portion 19 in which a bottom wall is formed of one member continuous with the electric wire connecting portion 17, the female connection portion 19 formed in a box shape by both side walls and the upper wall being bent.

Inside the connection portion 19, there is provided an elastic piece 29 having a contact portion 27 which is formed of one member continuous with the connection portion 19 and elastically deformable so as to have a predetermined energizing force.

The connection portion 19 is provided with an opening on one end side in the longitudinal direction. The tab-shaped connection portion of the mating terminal is inserted from the opening into the inside of the connection portion 19, and the contact portion 27 is brought into contact with the tab-shaped connection portion by the energizing force of the elastic piece 29, whereby the terminal 7 and the mating terminal are electrically connected to each other.

In a state where the terminal 7 with the box-shaped connection portion 19 is connected to the terminal portion of the electric wire 25 via the electric wire connecting portion 17, the terminal 7 is inserted from the insertion opening 13 of the terminal accommodating chamber 3 into the terminal accommodating chamber 3, and the electric wire 25 is drawn out of the housing 5 from the insertion opening 13.

On the outer periphery of the electric wires 25 drawn out of the housing 5, a mat seal 33 provided with a plurality of holes 31 into which the electric wires 25 are to be inserted in close contact with the outer periphery of the electric wires 25 is arranged.

In a state where the outer periphery of the mat seal 33 is accommodated in close contact with the inner periphery of the opening of the housing 5 positioned on the insertion opening 13 side of the terminal accommodating chamber 3, assembling the rear holder 37 provided with the plurality of holes 35 through which the electric wires 25 can be inserted into the housing 5 prevents the mat seal 33 from falling out of the housing 5.

The terminal 7 accommodated in the terminal accommodating chamber 3 is prevented from coming out of the insertion opening 13 of the terminal accommodating chamber 3 by being locked to the locking lance 9 provided in the terminal accommodating chamber 3.

A front holder 39 is assembled into the housing 5. The front holder 39 is formed with connection openings 15 into which the tab-shaped connection portions of the mating terminals are to be inserted.

The front holder 39 is arranged on the tip side of the connection portion 19 of the terminal 7 locked to the locking lance 9 in a state of being assembled into the housing 5, and prevents the terminal 7 from being further inserted into the terminal accommodating chamber 3.

The locking lance 9 is formed of one member where the base end side is continuous with the bottom wall of the terminal accommodating chamber 3 and is arranged on the connection opening 15 side of the front holder 39 so that the free end side is inclined toward the inside of the terminal accommodating chamber 3. The locking lance 9 is flexibly provided in a cantilever manner in the vertical direction inside the terminal accommodating chamber 3.

Figure 9:
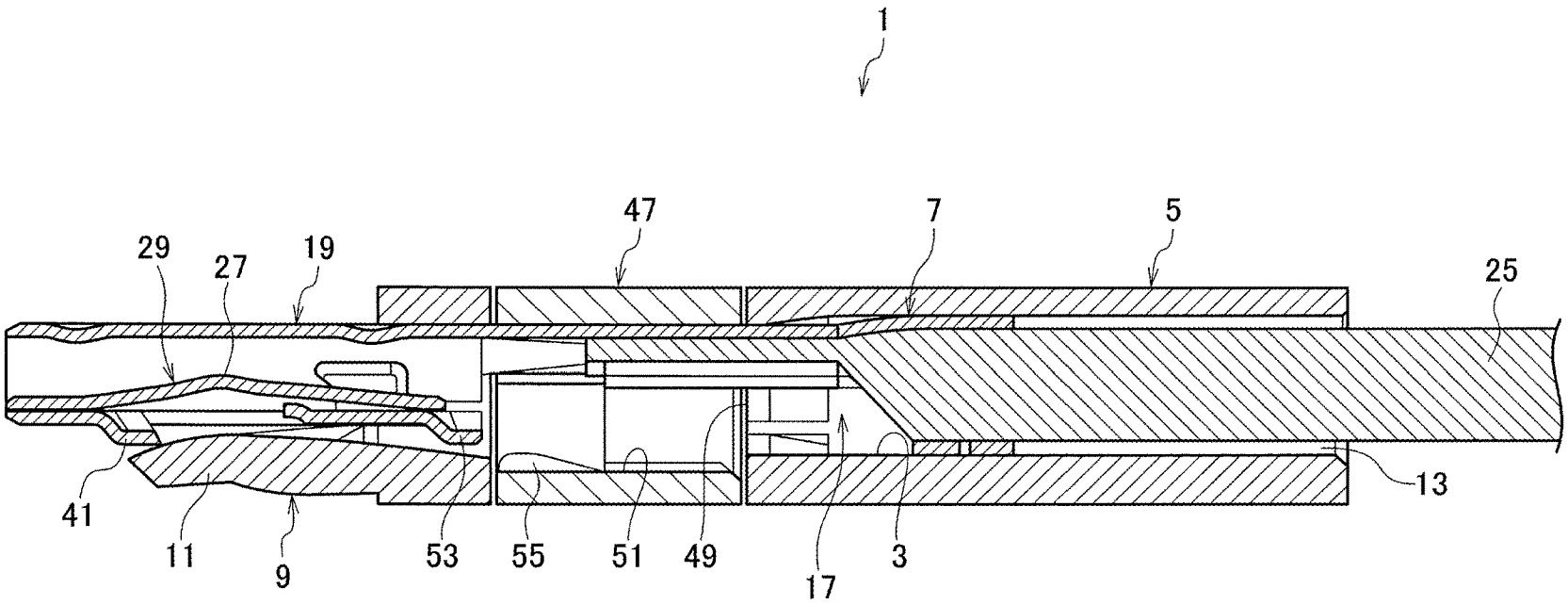
FIG. 9 is a cross-sectional view when the terminal of the connector according to the embodiment is accommodated in a terminal accommodating chamber.

When the terminal 7 is accommodated from the insertion opening 13 of the terminal accommodating chamber 3 of the housing 5 into the terminal accommodating chamber 3, the tip side of the connection portion 19 is inserted while sliding with the locking lance 9, whereby the locking lance 9 is bent toward the bottom wall side of the terminal accommodating chamber 3 (see FIG. 9).

Figure 10:
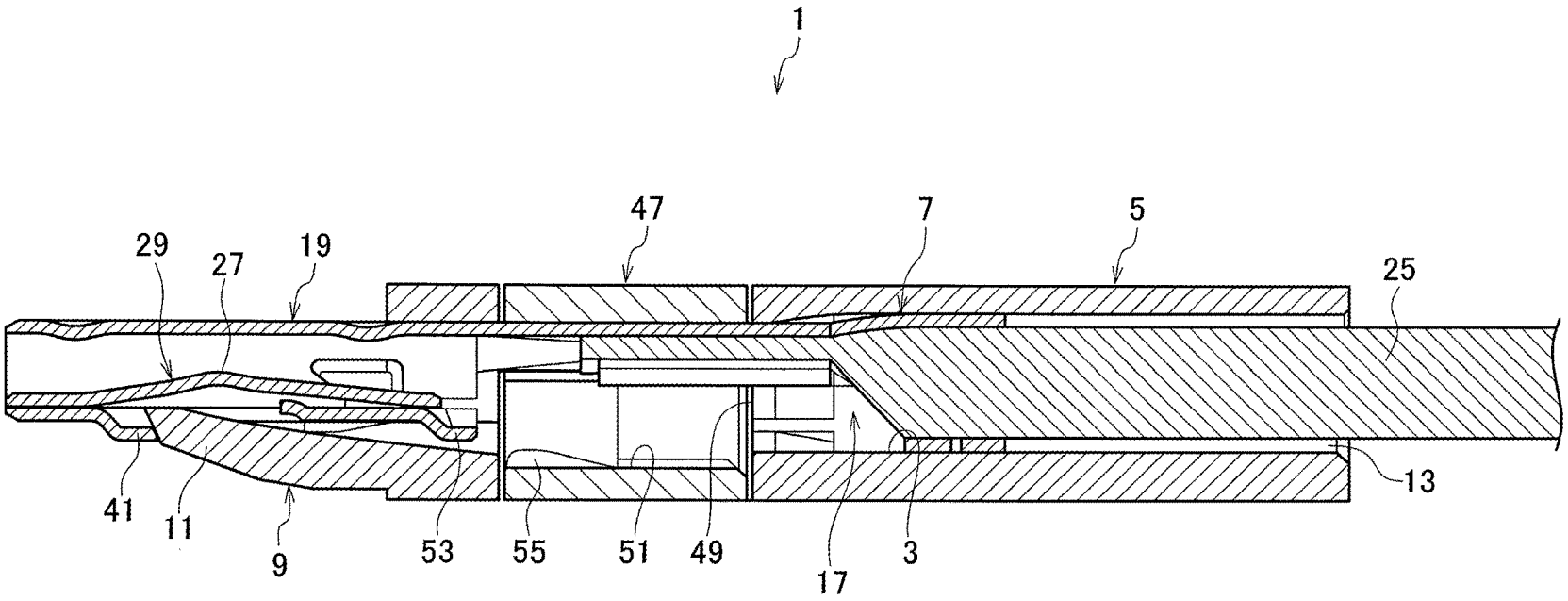
FIG. 10 is a cross-sectional view when the terminal of the connector according to the embodiment is accommodated in the terminal accommodating chamber.

Then, when the terminal 7 is placed in the proper position inside the terminal accommodating chamber 3, the locking lance 9 is restored, the free end side of the locking lance 9 is engaged with the locking projection 41 protruded toward the outside of the connection portion 19, and the terminal 7 is prevented from coming out of the terminal accommodating chamber 3 (see FIG. 10).

On the surface of the locking lance 9 on the side to be slid with the connection portion 19 of the terminal 7, a groove 43 for being engaged with the locking projection 41 of the connection portion 19 and for guiding the locking projection 41 to the free end side of the locking lance 9 is provided from the base end side of the locking lance 9 along the free end side (see FIGS. 3, 4, and 8A to 8C).

On one side in the width direction on the free end side of the locking lance 9, a releasing portion 45 for abutting on a releasing jig (not illustrated) to bend the locking lance 9 to release the engagement with the locking projection 41 is provided (see FIG. 4).

Here, in the locking lance of the conventional example, sliding with the connection portion of the terminal bends the locking lance while maintaining the shape of the locking lance from the base end side of the locking lance.

Therefore, in the locking lance of the conventional example, the stress when the locking lance is bent is concentrated on the base end side of the locking lance, and the base end side of the locking lance may be deformed or damaged.

Therefore, in the connector 1 according to the embodiment, the thin-walled portion 11 is provided on the free end side of the locking lance 9.

Figure 5:
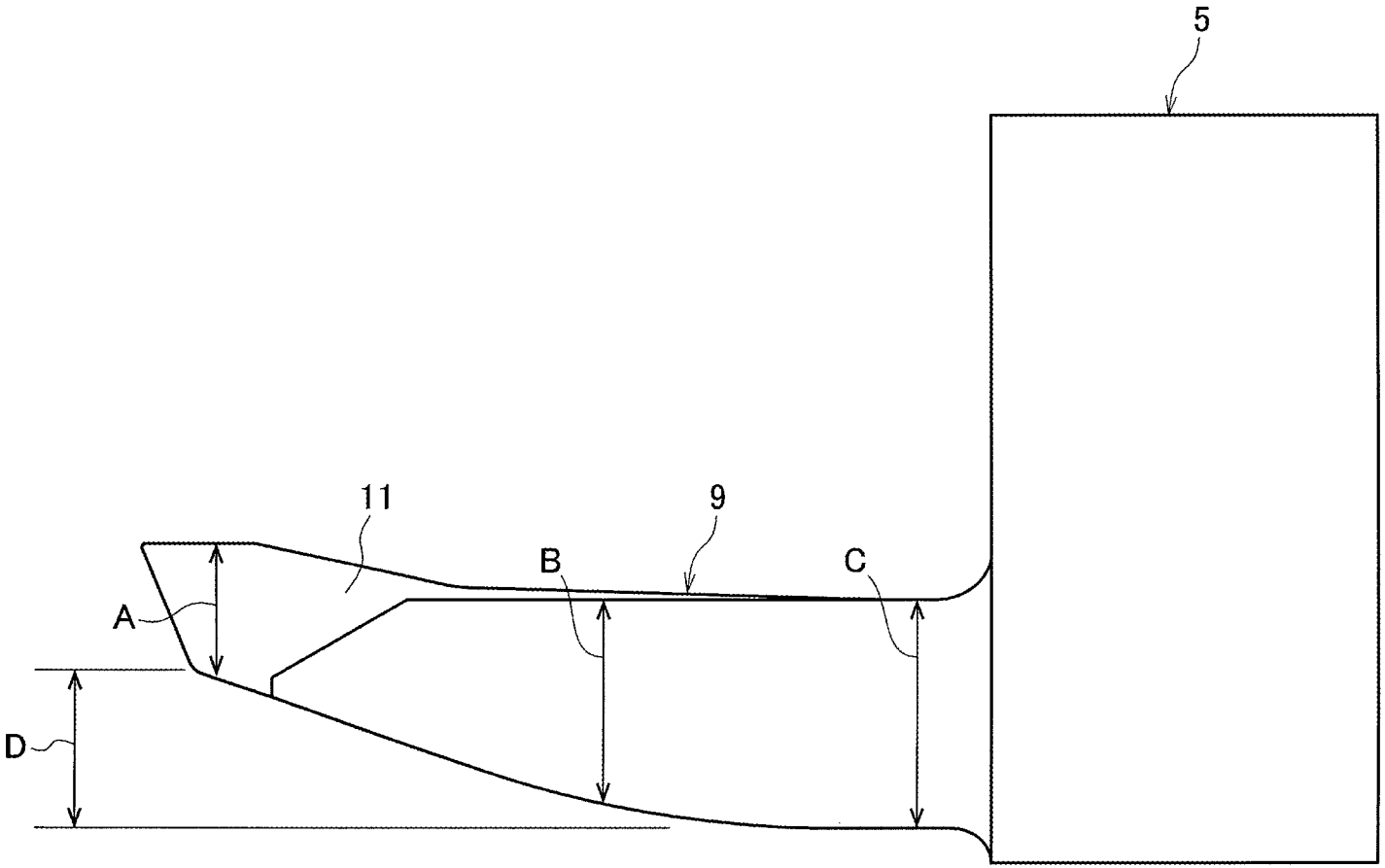
FIG. 5 is a side view of a locking lance of the connector according to the embodiment.
Figure 6:
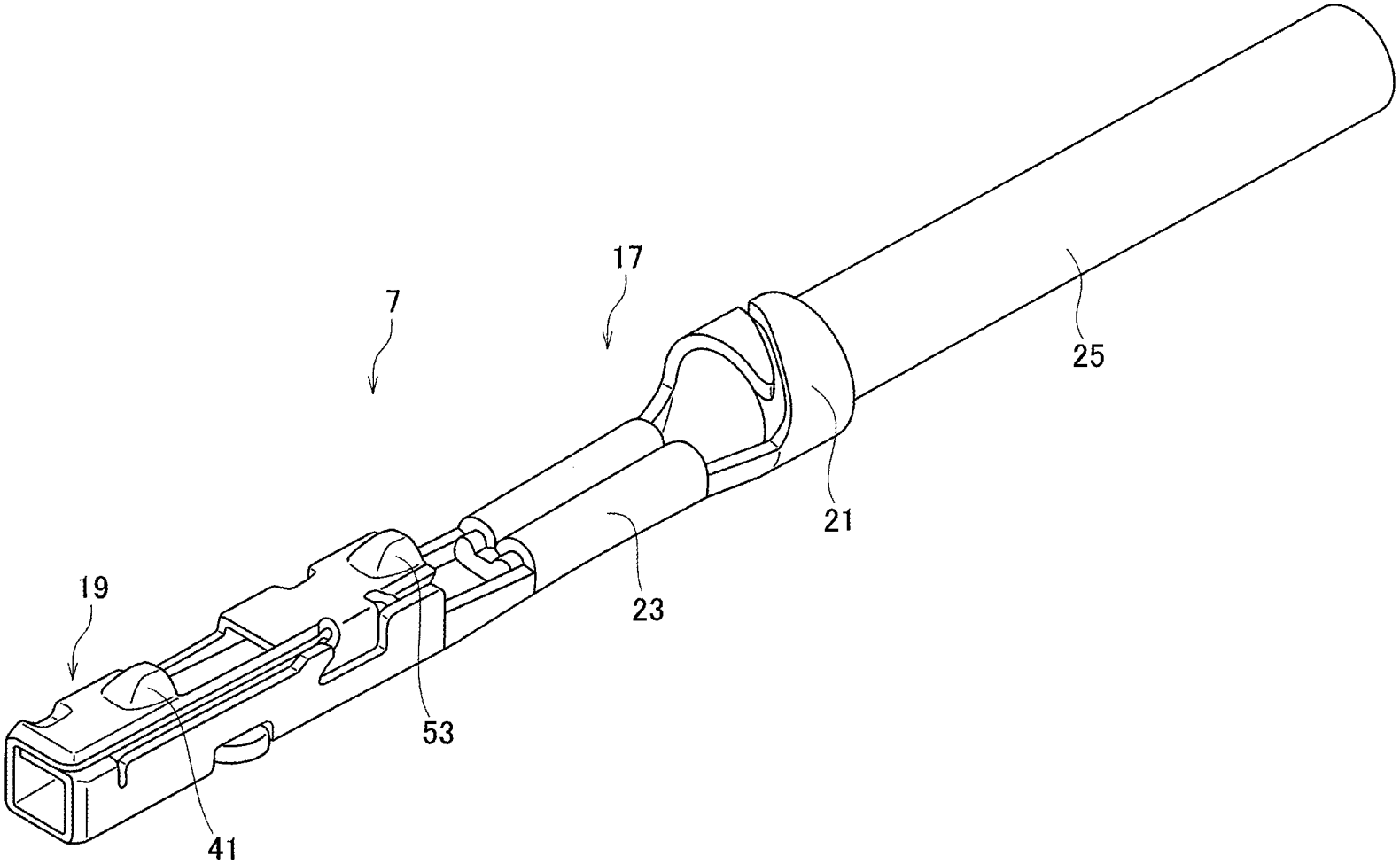
FIG. 6 is a perspective view when a terminal of the connector according to the embodiment is connected to an end portion of an electric wire.
Figure 7:
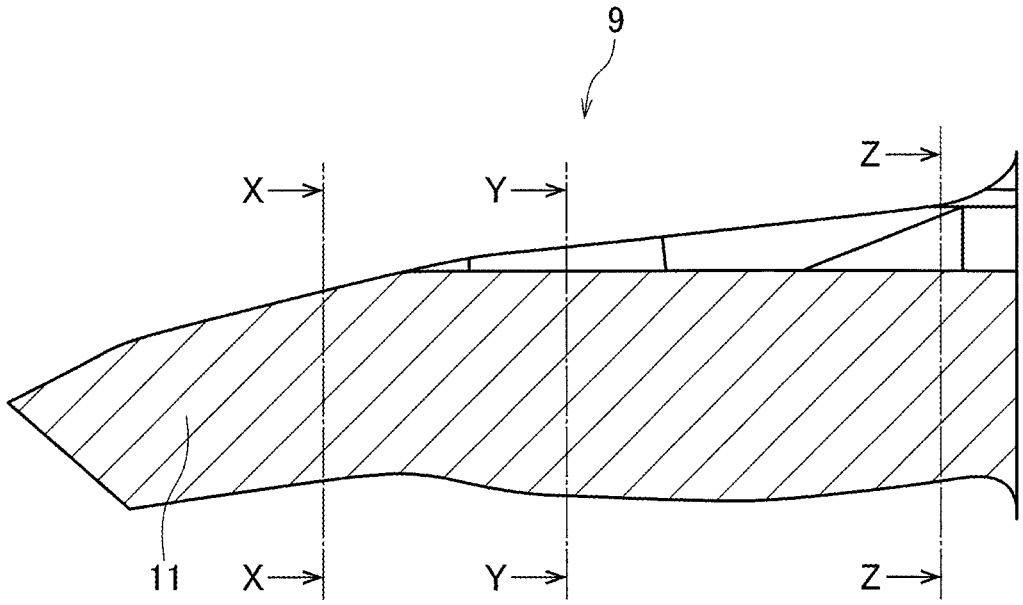
FIG. 7 is a cross-sectional view of the connector according to the embodiment with the locking lance bent.
Figure 8A:
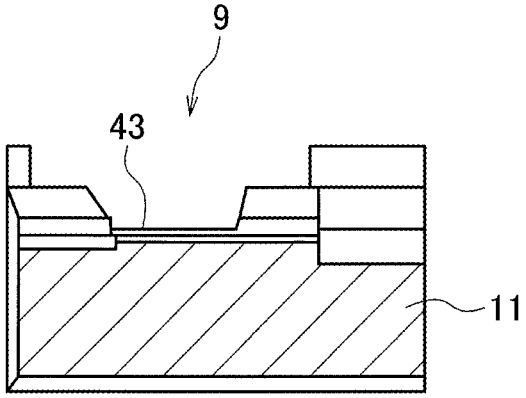
FIG. 8A is a cross-sectional view taken along the line X-X in FIG. 7.
Figure 8B:
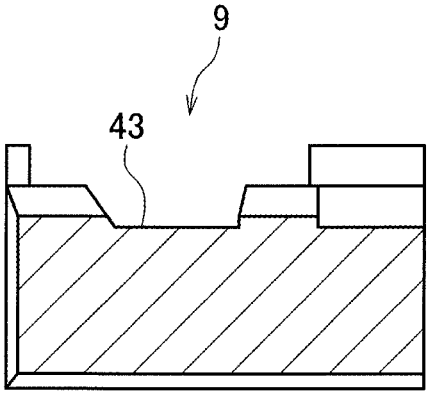
FIG. 8B is a cross-sectional view taken along the line Y-Y in FIG. 7.
Figure 8C:
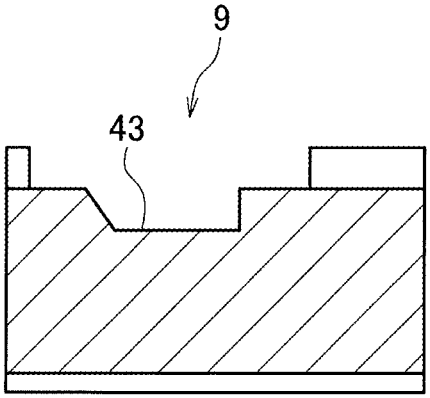
FIG. 8C is a cross-sectional view taken along the line Z-Z in FIG. 7.

The thin-walled portion 11 is provided on the free end side of the locking lance 9, and a thickness A in the bending direction of the locking lance 9 is set to be smaller than a thickness C on the base end side of the locking lance 9 (see FIG. 5).

The thin-walled portion 11 is provided on the free end side of the locking lance 9 so as to be flexible toward the bottom wall side of the terminal accommodating chamber 3 by sliding with the connection portion 19 of the terminal 7.

In the locking lance 9 where the thin-walled portion 11 is provided, when the connection portion 19 of the terminal 7 and the base end side of locking lance 9 slide with each other, the entire locking lance 9 starts bending with the base end side of the locking lance 9 as a base point.

When the insertion of the terminal 7 is continued from this state and the connection portion 19 of the terminal 7 and the thin-walled portion 11 slide with each other, the thin-walled portion 11 starts bending.

At this time, the stress applied to the base end side of the locking lance 9 is dispersed in the thin-walled portion 11, whereby the stress is prevented from concentrating on the base end side of the locking lance 9.

Providing the flexible thin-walled portion 11 on the free end side of the locking lance 9 prevents the stress when the locking lance 9 is bent from concentrating on the base end side of the locking lance 9, and prevents deformation, damage, or the like from occurring on the base end side of the locking lance 9.

The thickness of the locking lance 9 in the bending direction is continuously set smaller from the base end side to the free end side of the locking lance 9.

Specifically, as illustrated in FIG. 5, the locking lance 9 is formed so that the thickness B in the intermediate portion is made smaller than the thickness C on the base end side, and the thickness A in the thin-walled portion 11 is made smaller than the thickness B in the intermediate portion. That is, the locking lance 9 is formed so that the thickness of the locking lance 9 gradually decreases from the base end side to the free end side as a whole.

Gradually reducing the thickness of the locking lance 9 from the base end side to the free end side allows the locking lance 9 to be bent due to the sliding with the connection portion 19 of the terminal 7 in the entire region in the length direction of the locking lance 9. Therefore, the stress when the locking lance 9 is bent can be dispersed in a plurality of places of the locking lance 9.

The locking lance 9 is formed in an arc shape from the base end side to the free end side so that the free end faces the terminal 7 side.

Forming the locking lance 9 in an arc shape allows the length of the locking lance 9 to be reduced as compared with the case where the locking lance 9 is formed in a straight shape and the housing 5 to be reduced in size in the length direction.

The free end side of the locking lance 9 is arranged on the terminal 7 side from the base end side of the locking lance 9 by the amount of the deflection margin of the locking lance 9 with respect to the direction of its own bending.

Specifically, as illustrated in FIG. 5, let D be the deflection margin of the whole locking lance 9 when sliding with the connection portion 19 of the terminal 7, then the free end side of locking lance 9 is arranged on the terminal 7 side from the base end side of locking lance 9 by the amount of the deflection margin D with respect to the bending direction of itself.

Arranging the free end side of the locking lance 9 in this way causes the terminal 7 to slide with the connection portion 19, whereby the locking lance 9 bends also on the thin-walled portion 11 side, so that the locking lance 9 itself can be provided with the deflection margin D of the locking lance 9.

For this reason, since the entire locking lance 9 does not bend toward the bottom wall side of the terminal accommodating chamber 3 by the amount of the deflection margin D with the base end side of the locking lance 9 as a base point, there is no need to provide a space that allows bending of the locking lance 9 on the bending direction side of the locking lance 9 in the terminal accommodating chamber 3, so that the housing 5 can be reduced in size in the height direction.

Openings of the insertion holes 49 with which the plurality of terminal accommodating chambers 3 are communicated and into which a spacer 47 can be inserted are provided on the side wall of housing 5.

The spacer 47 is provided with a plurality of holes 51 through which the terminals 7 can be inserted. Inside each hole 51, a locking portion 55 engageable with a double locking projection 53 protruding toward the outside of the terminal 7 is protruded.

When the terminal 7 is accommodated in the terminal accommodating chamber 3, the spacer 47 is inserted into the insertion hole 49 in a temporarily locked state, is arranged in the position where the locking portion 55 does not interfere with the double locking projection 53 of the connection portion 19, and allows the terminal 7 to pass through the hole 51.

Then, inserting the spacer 47 into the insertion hole 49 so as to be in the final locking state in a state where the terminal 7 is accommodated in the proper position of the terminal accommodating chamber 3, that is, in a state where the locking projection 41 of the connection portion 19 and the free end side of the locking lance 9 are engaged with each other causes the locking portion 55 to be arranged engageably with the double locking projection 53 of the connection portion 19 and the terminal 7 to be doubly locked to the terminal accommodating chamber 3.

In the connector 1 according to the embodiment, on the free end side of the locking lance 9, a thin-walled portion 11 where the thickness of the locking lance 9 in the bending direction is set smaller than that of the locking lance 9 on the base end side is provided. Then, when the terminal 7 is inserted into the terminal accommodating chamber 3, the free end side abuts on the terminal 7, whereby the thin-walled portion 11 also bends in addition to the bending on the base end side of the locking lance 9.

For this reason, the stress when the locking lance 9 is bent can be dispersed to the base end side of the locking lance 9 and the thin-walled portion 11, the base end side of the locking lance 9 can be prevented from being deformed or damaged, and the strength on the base end side of the locking lance 9 can be maintained.

Therefore, in the connector 1 according to the embodiment, the concentration of the stress on the base end side of the locking lance 9 due to the bending of the thin-walled portion 11 can be prevented, and the holding of the terminal 7 with the locking lance 9 can be stabilized.

The locking lance 9 is set so that the thickness in the bending direction becomes continuously thinner from the base end side to the free end side. For this reason, the stress caused by the bending of the locking lance 9 in a plurality of places between the base end and the free end of the locking lance 9 can be dispersed, and further, the strength on the base end side of the locking lance 9 can be maintained.

The locking lance 9 is formed in an arc shape from the base end side to the free end side. As compared with the case where the locking lance 9 is formed in a straight line, the length of the locking lance 9 can be reduced, and the connector 1 can be reduced in size.

The free end side of the locking lance 9 is arranged on the terminal 7 side from the base end side of the locking lance 9 by the amount of the deflection margin D of the locking lance 9 with respect to the direction of its own bending. Providing the locking lance 9 itself with a deflection margin D with respect to the direction of its own bending makes it unnecessary to provide a space for allowing bending of the locking lance 9 in the terminal accommodating chamber 3, and the connector 1 can be reduced in size.

Although in the connector 1 according to the embodiment, the front holder 39 is assembled to the housing 5, and the connection openings 15 are formed in the front holder 39, the present invention is not limited thereto, and the connection openings may be formed in the terminal accommodating chamber 3 without the front holder 39 being assembled to the housing 5.

In addition, although the lever (not illustrated) is assembled to the housing 5, the present invention is not limited thereto, and the lever may be fitted into a mating housing (not illustrated) without the lever being assembled to the housing 5.

What is claimed is:

1. A connector, comprising:

a housing including a terminal accommodating chamber;

a terminal configured to be accommodated in the terminal accommodating chamber; and a locking lance flexibly provided in the terminal accommodating chamber, a free end side of the locking lance configured to abut on the terminal when the terminal is inserted into the terminal accommodating chamber, thereby the locking lance being configured to be restored after being bent, thereby the free end side being configured to lock the terminal in the terminal accommodating chamber, wherein a thickness of the locking lance in a bending direction from the top of the locking lance to the bottom of the locking lance changes gradually so as to be smaller at the free end side thereof than at a base end side thereof, wherein the thickness of the locking lance in the bending direction continuously becomes smaller from the base end side to the free end side, wherein the locking lance is formed in an arc shape from the base end side to the free end side with respect to the bending direction of the locking lance, wherein the free end side of the locking lance is configured to deflect by a deflection margin in the bending direction with respect to the base end side of the locking lance, wherein the locking lance includes a groove provided in the free end side thereof, the groove being configured to engage with a locking projection of the terminal, and, wherein the thickness of the locking lance in the bending direction gradually becomes smaller from the base end side to the free end side.

* * * * *